US008741518B2

(12) United States Patent
Kaneko et al.

(10) Patent No.: US 8,741,518 B2
(45) Date of Patent: Jun. 3, 2014

(54) TONER

(75) Inventors: Hideki Kaneko, Yokohama (JP); Shinya Yachi, Mishima (JP); Kenichi Nakayama, Numazu (JP); Takeshi Kaburagi, Suntou-gun (JP); Shiro Kuroki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 13/085,356

(22) Filed: Apr. 12, 2011

(65) Prior Publication Data

US 2011/0256477 A1 Oct. 20, 2011

(30) Foreign Application Priority Data

Apr. 14, 2010 (JP) ..... 2010-093351

(51) Int. Cl.
*G03G 9/087* (2006.01)

(52) U.S. Cl.
USPC ..... 430/109.3; 430/109.4; 430/137.15

(58) Field of Classification Search
USPC ..... 430/109.3, 109.4, 137.15
See application file for complete search history.

(56) References Cited

U.S. PATENT DOCUMENTS

2004/0162373 A1 8/2004 Cheng et al.

FOREIGN PATENT DOCUMENTS

| | | | |
|---|---|---|---|
| EP | 460243 | A1 | 12/1991 |
| EP | 1967911 | A1 | 9/2008 |
| JP | 2008-268366 | A | 11/2008 |
| JP | 2009-151235 | A | 7/2009 |

*Primary Examiner* — Jonathan Jelsma

(74) *Attorney, Agent, or Firm* — Canon U.S.A., Inc., IP Division

(57) ABSTRACT

A toner includes toner particles each containing a binder resin, a colorant, and a carboxy-containing styrene-based resin, in which the toner particles are produced in an aqueous medium, each of the toner particles has a styrene-acrylic-based resin component content of 50.0% by mass or more, cyclohexane-insoluble matter A obtained by subjecting the toner to Soxhlet extraction with cyclohexane for 4 hours is 70.0% by mass or more, and cyclohexane-insoluble matter B obtained by subjecting the toner to Soxhlet extraction with cyclohexane for 24 hours is 40.0% by mass or less, and wherein when the z-average molecular weight and the weight-average molecular weight of tetrahydrofuran-soluble matter of the carboxy-containing styrene-based resin determined by gel permeation chromatography measurement are represented by Mz and Mw, respectively, Mz and Mw satisfy the following expressions:

$10{,}000 \leq Mw \leq 30{,}000$, and $1.62 \leq Mz/Mw \leq 5.00$.

7 Claims, No Drawings

TONER

BACKGROUND OF THE INVENTION

1. Field of the Invention

The present invention relates to a toner for use in an image forming method, such as an electrophotographic method, an electrostatic recording method, and a toner jet method.

2. Description of the Related Art

In recent years, a rapid increase in the speed of laser printers and copiers using electrophotography has required a toner having excellent developability, transferability, and low-temperature fixability. In particular, improvement in low-temperature fixability leads to a reduction in power consumption and is essentially required in the development of an environmentally-friendly toner.

With growing markets for laser printers and copiers, a toner is required to reliably provide performance even when stored or used in a high temperature and high humidity environment. Furthermore, the temperature in an apparatus tends to increase because of the miniaturization of the apparatus and a silent, fan-less design. So, a toner is required to have higher heat resistance.

To meet such requirements, toners with a core-shell structure, in which surfaces of toner particles are designed to have heat resistance and durability and cores of toner particles are designed to have low-temperature fixability, have been studied.

Japanese Patent Laid-Open No. 2008-268366 discloses a toner containing a low-molecular-weight polar vinyl resin having a specific acid value, the resin being arranged between the core and the shell of each toner particle, whereby the toner can form an image with high glossiness even when fixed at a low temperature and has high durability even under severe conditions of use. Japanese Patent Laid-Open No. 2009-151235 discloses a toner having excellent low-temperature fixability and durability and containing toner particles produced in an aqueous medium, in which the glass transition temperature Tg of cyclohexane-insoluble matter in tetrahydrofuran-soluble matter is a specific value.

However, a toner is now required to have a higher level of heat resistance. It is difficult to produce a toner having durability that meets the level in the related art described above. Furthermore, it is difficult to produce a toner that has high durability and that simultaneously meets high developability, high transferability, and low-temperature fixability.

SUMMARY OF THE INVENTION

According to aspects of the present invention, a toner includes toner particles each containing a binder resin, a colorant, and a carboxy-containing styrene-based resin, in which the toner particles are produced in an aqueous medium, each of the toner particles contains 50.0% by mass or more of a styrene-acrylic-based resin component, cyclohexane-insoluble matter A obtained by subjecting the toner to Soxhlet extraction with cyclohexane for 4 hours is 70.0% by mass or more, and cyclohexane-insoluble matter B obtained by subjecting the toner to Soxhlet extraction with cyclohexane for 24 hours is 40.0% by mass or less, and wherein when the z-average molecular weight and the weight-average molecular weight of a tetrahydrofuran-soluble matter of the carboxy-containing styrene-based resin determined by gel permeation chromatography measurement are represented by Mz and Mw, respectively, Mz and Mw satisfy the following expressions:

$10{,}000 \leq Mw \leq 30{,}000$, and $1.62 \leq Mz/Mw \leq 5.00$.

Further features of the present invention will become apparent from the following description of exemplary embodiments.

DESCRIPTION OF THE EMBODIMENTS

A toner according to aspects of the present invention contains a styrene-acrylic-based resin as a main component. Specifically, toner particles according to aspects of the present invention each have a styrene-acrylic-based resin component content of 50.0% by mass or more, such as 65.0% by mass or more, and even 80.0% by mass. According to aspects of the present invention, the term "each of toner particles contains 50.0% by mass or more of a styrene-acrylic-based resin component" indicates that the proportion of the total number of parts by mass of materials (for example, styrene, n-butyl acrylate, and a carboxy-containing styrene-based resin) to be formed into the styrene-acrylic-based resin component is 50.0% by mass or more with respect to the total number of parts by mass of materials used for the formation of the toner particles. A styrene-acrylic-based resin component content of 50.0% by mass or more of each toner particle results in the toner having satisfactory developability and durability.

The toner particles used in aspects of the present invention contain carboxy-containing styrene-based resin and is produced in an aqueous medium. The carboxy-containing styrene-based resin contains a highly polar carboxy group. So, in the case where the toner particles are produced using the carboxy-containing styrene-based resin in the aqueous medium, the carboxy-containing styrene-based resin is present in the vicinity of the surface of each toner particle. Here, the carboxy-containing styrene-based resin is highly compatible with the styrene-acrylic-based resin. Thus, the carboxy-containing styrene-based resin is present in such a manner that the proportion of the carboxy-containing styrene-based resin is gradually increased from an inner portion to the surface of each toner particle. As a result, phase separation between the carboxy-containing styrene-based resin and a binder resin is less likely to occur, so that the toner has high durability.

The inventors have found that in the case of the toner containing the styrene-acrylic-based resin as a main component and the carboxy-containing styrene-based resin, according to aspects of the invention the toner contains predetermined amounts of cyclohexane-insoluble matter A (hereinafter, also referred to as "insoluble matter A") obtained by subjecting the toner to Soxhlet extraction with cyclohexane for 4 hours and cyclohexane-insoluble matter B (hereinafter, also referred to as "insoluble matter B") by subjecting the toner to Soxhlet extraction with cyclohexane for 24 hours in order to overcome the foregoing problems. That is, the toner according to aspects of the present invention has a cyclohexane-insoluble matter A content of 70.0% by mass or more and a cyclohexane-insoluble matter B content of 40.0% by mass or less. A cyclohexane-insoluble matter A content of 70.0% by mass or more results in the toner having high durability. A cyclohexane-insoluble matter B content of 40.0% by mass or less enables the toner to be sufficiently melted during fixation, so that the toner provides satisfactory low-temperature fixability. Without being limited to any one particular theory, a possible reason for this is as described below.

The styrene-acrylic-based resin has a high solubility in cyclohexane. A highly polar resin, such as a polyester resin, has a low solubility in cyclohexane. Even in the case of the styrene-acrylic-based resin, if the resin has a three-dimensional network structure due to a crosslinking agent or the like or has a high molecular weight, the solubility is reduced. The inventors have conducted intensive studies and have found that cyclohexane-insoluble matter A correlates highly with the durability of the toner and that cyclohexane-insoluble matter B correlates highly with the low-temperature fixability of the toner.

In the case where the carboxy-containing styrene-based resin having a three-dimensional network structure by crosslinking or a highly polar resin, such as a polyester resin, is uniformly present in the vicinity of the surface of each of the toner particles, the toner particles have high durability and blocking resistance. In the case where the toner particles are subjected to Soxhlet extraction with cyclohexane for 4 hours, the dissolution of the styrene-acrylic-based resin located inside each toner particle is inhibited by the low-solubility component in the vicinity of the surface of each toner particle, so that the amount of cyclohexane-insoluble matter A tends to increase. Thus, a larger amount of cyclohexane-insoluble matter A of the toner results in the toner having higher durability.

In the case where Soxhlet extraction is performed with cyclohexane for 24 hours, it is believed that cyclohexane penetrates to the inside each toner particle and that cyclohexane-soluble components are almost completely dissolved. The cyclohexane-soluble components are derived from the styrene-acrylic-based resin having a low molecular weight. Larger amounts of such components (a smaller amount of cyclohexane-insoluble matter B) result in the toner having better low-temperature fixability.

In aspects of the present invention, the reason the amounts of cyclohexane-insoluble matter obtained by performing the extraction for 4 hours and 24 hours are specified is described below. If components that are not readily dissolved in cyclohexane are more uniformly present in the vicinity of the surface of each toner particle, cyclohexane-soluble components located inside each toner particle are more slowly eluted. So, in order to study the extent to which the components that are not readily dissolved in cyclohexane is densely present in the vicinity of the surface of each toner particle, it is necessary to set the time required for penetration of cyclohexane to the toner particles. However, it is not appropriate to set an excessively long extraction time such that cyclohexane-soluble components are completely dissolved. From this point of view, the time for extraction with cyclohexane is appropriately set to 4 hours. So, the amount of the cyclohexane-insoluble matter obtained by performing the extraction for 4 hours is specified. When the extraction is performed with cyclohexane for 24 hours, the cyclohexane-soluble components in the toner are almost completely dissolved. Thus, in the case where the amount of the cyclohexane-insoluble matter is specified at an extraction time of 24 hours, the specified amount serves as an index of the proportion of a component that contributes to the low-temperature fixability of the toner. From this point of view, the amount of the cyclohexane-insoluble matter obtained by performing the extraction for 24 hours is specified.

The amounts of insoluble matter A and insoluble matter B can be adjusted by controlling the compositions of the binder resin, the styrene-acrylic-based resin, and so forth and the amount and type of crosslinking agent added during polymerization. In particular, in the case where the carboxy-containing styrene-based resin located in the vicinity of the surface of each toner particle has an appropriately cross-linked structure, the amounts of insoluble matter A and insoluble matter B can be appropriately adjusted. To produce the toner particles having such a structure, the toner particles can be produced in an aqueous medium using the carboxy-containing styrene-based resin that is appropriately cross-linked, provided that the styrene-acrylic-based resin is used as the binder resin.

The tetrahydrofuran (THF)-soluble matter of the carboxy-containing styrene-based resin used in aspects of the present invention has a weight-average molecular weight Mw of 10,000 to 30,000, which is determined by gel permeation chromatography (GPC) measurement. The use of the carboxy-containing styrene-based resin having a weight-average molecular weight (Mw) of 10,000 or more allows the toner containing the resin to have high durability. An excessively high Mw of the carboxy-containing styrene-based resin located in the vicinity of the surface of each toner particle presumably inhibits the flowability of the binder resin in the toner during fixation. The use of the resin having a weight-average molecular weight (Mw) of 30,000 or less does not inhibit the flowability of the binder resin during fixation and enables sufficient adhesion between the melted toner and paper to be maintained, thereby resulting in the toner having satisfactory low-temperature fixability.

The toner according to aspects of the present invention is characterized in that when the z-average molecular weight and the weight-average molecular weight of THF-soluble matter of the carboxy-containing styrene-based resin determined by GPC are represented by Mz and Mw, respectively, Mz/Mw is in the range of 1.62 to 5.00. The ratio Mz/Mw of the carboxy-containing styrene-based resin serves as an index of the proportion of a component having a three-dimensional network structure in the resin.

A larger value of Mz/Mw indicates a higher proportion of the component having a three-dimensional network structure in the carboxy-containing styrene-based resin. As described above, in the case where the carboxy-containing styrene-based resin is located in the vicinity of the surface of each toner particle and has a three-dimensional network structure, the toner has improved durability and blocking resistance. In the case where Mz/Mw is 1.62 or more, the toner has high durability. So, even if the toner is allowed to stand in a high temperature environment, it is possible to inhibit the bleeding of a low-molecular-weight component in the binder resin and wax. An excessively high value of Mz/Mw results in an excessively high proportion of the component having a three-dimensional network structure in the carboxy-containing styrene-based resin, thereby reducing the flowability of the binder resin in the toner during fixation. In the case where Mz/Mw is 5.00 or less, the flowability of the binder resin is not inhibited during fixation. Furthermore, it is possible to maintain sufficient adhesion between the melted toner and paper, thereby resulting in the toner having satisfactory low-temperature fixability.

The toner particles used in aspects of the present invention may have a carboxy-containing styrene-based resin content of 5.0% by mass to 23.0% by mass such as 7.0% by mass to 14.0% by mass. The term "the toner particles used in aspects of the present invention have a carboxy-containing styrene-based resin content of 5.0% by mass to 23.0% by mass" indicates that the proportion of the number of parts by mass of the carboxy-containing styrene-based resin is 5.0% by mass to 23.0% by mass with respect to the total number of parts by mass of materials used for the formation of the toner particles.

The carboxy-containing styrene-based resin has a polarity. So, in the case of the production of the toner particles in an aqueous medium, it is believed that the carboxy-containing styrene-based resin is likely to be located in the vicinity of the surface of each toner particle. In the case where each toner particle has a carboxy-containing styrene-based resin content of 5.0% by mass or more, the substantially entire surface of each toner particle can be covered with the resin. In this case, a low-molecular-weight component in the binder resin and a wax component are less likely to be exposed at the surface of each toner particle, thereby resulting in the toner having high durability. An excessively high carboxy-containing styrene-based resin content presumably inhibits the flowability of the binder resin in the toner during fixation. In the case where the toner has a carboxy-containing styrene-based resin content of 20.0% by mass or less, the flowability of the binder resin is not inhibited during fixation. Furthermore, it is possible to maintain sufficient adhesion between the melted toner and paper, thereby resulting in the toner having satisfactory low-temperature fixability.

The carboxy-containing styrene-based resin used in aspects of the present invention can contain a hydroxy group. The carboxy-containing styrene-based resin that contains the hydroxy group is appropriately cross-linked by a condensation reaction to form a three-dimensional network structure, so that Mz/Mw can be set in an appropriate range. Furthermore, in the case where the toner particles are formed using the resin in an aqueous medium, the resin having a three-dimensional network structure is located in the vicinity of the surface of each toner particle. This makes it possible to set the amount of insoluble matter A in an appropriate range.

With respect to the carboxy-containing styrene-based resin used in aspects of the present invention, when the hydroxyl value and the acid value of the resin are OHv (mg KOH/g) and Av (mg KOH/g), respectively, OHv can be in the range of 5.0 to 30.0 mg KOH/g, and Av can be in the range of 5.0 to 25.0 mg KOH/g. In the case where the carboxy-containing styrene-based resin in the toner contains a hydroxy group and where OHv is 5.0 mg KOH/g or more, it is possible to sufficiently produce a triboelectric charge even in a high-temperature and high-humidity environment, thereby resulting in satisfactory fog resistance. In the case where Av is 5.0 mg KOH/g or more, satisfactory fog resistance is also provided. In the case where OHv is 30.0 mg KOH/g or less, the fog resistance (incubation fog resistance) when the toner is allowed to stand in a high-temperature and high-humidity environment is satisfactory. This is because when OHv is 30.0 mg KOH/g or less, it is possible to suppress the amount of water adsorbed by the resin located in the vicinity of the surface of each toner particle and to prevent a reduction in the triboelectric charge of the toner that is allowed to stand in a high-temperature and high-humidity environment. In the case where the carboxy-containing styrene-based resin in the toner has an acid value to 25.0 mg KOH/g or less, the incubation fog resistance is satisfactory. Furthermore, in the case where the acid value and the hydroxyl value of the carboxy-containing styrene-based resin are in the range described above, it is possible to further appropriately control the cross-linked state and the polarity of the resin. This makes it possible to adjust Mz/Mw and insoluble matter A to more appropriate values.

Furthermore, the toner according to aspects of the present invention can have a viscosity of 10,000 Pa·s to 25,000 Pa·s at 100° C. The use of the toner having a viscosity of 10,000 Pa·s or more at 100° C. increases toughness, thereby increasing the effect of preventing the contamination of a member, such as a developer carrying member. In the case of the toner having a viscosity of 25,000 Pa·s or less at 100° C., it is possible to ensure sufficient adhesion to transfer paper, thereby resulting in particularly satisfactory low-temperature fixability and winding properties. Furthermore, it is possible to form a fixed image having high glossiness. The viscosity can be adjusted to the foregoing range by controlling the reaction temperature and the amount of a polymerization initiator added.

Examples of the carboxy-containing styrene-based resin that can be used in aspects of the present invention include copolymers of styrene-based monomers, such as styrene, o-methylstyrene, m-methylstyrene, p-methylstyrene, p-methoxylstyrene, and p-ethylstyrene, and carboxy-containing monomers, such as acrylic acid, methacrylic acid, α-ethylacrylic acid, crotonic acid, cinnamic acid, vinyl acid, isocrotonic acid, tiglic acid, angelic acid, fumaric acid, maleic acid, citraconic acid, alkenylsuccinic acid, itaconic acid, mesaconic acid, dimethylmaleic acid, dimethylfumaric acid, monoester derivatives thereof, anhydrides thereof, and α- or β-alkyl derivatives. Furthermore, a hydroxy-containing monomer, such as 2-hydroxyethyl methacrylate, and the foregoing monomers may be copolymerized to prepare the carboxy-containing styrene-based resin containing a hydroxy group.

The carboxy-containing styrene-based resin can have a glass transition temperature Tg of 80° C. to 120° C., the glass transition temperature Tg being measured with a differential scanning calorimeter (DSC).

Furthermore, the toner according to aspects of the present invention can contain a polyester resin in order to improve blocking resistance. To control physical properties, such as the blocking resistance, durability, and fixability, one or both of a saturated polyester resin and an unsaturated polyester resin may be appropriately used. Examples of an alcohol component and an acid component that are used to form the polyester resin are described below.

Examples of the alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by general formula (A):

(A)

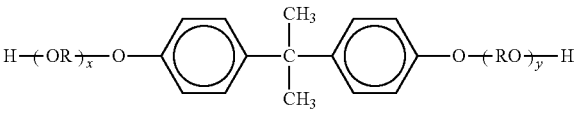

[wherein Rs each represent an ethylene group or a propylene group; x and y each represent an integer of 1 or more, and the average of x+y is 2 to 10], hydrogenated compounds of compounds represented by general formula (A), diols represented by general formula (B):

(B)

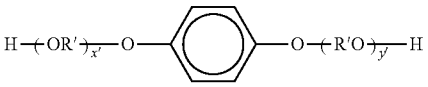

(wherein R's each represent —$CH_2CH_2$—,

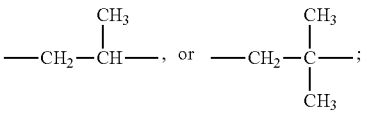

and x' and y' each represent an integer of 0 or more, and the average of x'+y' is 0 to 10), and hydrogenated diols of compounds of general formula (B).

Furthermore, examples thereof include polyhydric alcohols, such as glycerol, pentaerythritol, sorbitol, sorbitan, and oxyalkylene ether of novolac-type phenolic resins.

Examples of divalent carboxylic acid include benzenedicarboxylic acids, such as phthalic acid, terephthalic acid, and isophthalic acid, and anhydrides thereof, such as phthalic anhydride; alkyldicarboxylic acids, such as succinic acid, adipic acid, sebacic acid, and azelaic acid, and anhydrides thereof; succinic acid substituted with an alkyl or alkenyl group having 6 to 18 carbon atoms, and anhydrides thereof; unsaturated dicarboxylic acids, such as fumaric acid, maleic acid, citraconic acid, and itaconic acid, and anhydrides thereof; and polyvalent carboxylic acids, such as trimellitic acid, pyromellitic acid, 1,2,3,4-butanetetracarboxylic acid, benzophenonetetracarboxylic acid, and anhydrides thereof.

The polyester resin may have a glass transition temperature (Tg) of 50° C. to 80° C. and even 60° C. to 80° C. The use of the polyester resin having a glass transition temperature Tg of 50° C. or higher results in the toner having high durability. The use of the polyester resin having a glass transition temperature Tg of 80° C. or lower results in the toner having satisfactory low-temperature fixability.

The polyester resin may have a weight-average molecular weight (Mw) of 6,000 to 100,000 and even 6,500 to 85,000. The use of the polyester resin having a weight-average molecular weight Mw of 6,000 or more results in the toner having high durability. The use of the polyester resin having a weight-average molecular weight Mw of 100,000 or less results in the toner having satisfactory offset resistance.

The polyester resin may have an acid value of 0.1 to 50 mg KOH/g and even 5 to 35 mg KOH/g. In the case where the acid value of the polyester resin falls within the above range, the polyester resin can be present on the surface of each toner particle in an appropriate amount without adversely affecting the chargeability of the toner particles.

Examples of wax include petroleum waxes, such as a paraffin wax, a microcrystalline wax, and petrolatum, and derivatives thereof; montan wax and derivatives thereof; hydrocarbon wax synthesized by the Fischer-Tropsch process, and derivatives thereof; and polyolefin waxes, such as a polyethylene wax and polypropylene wax, and derivatives thereof. These derivatives include oxides, block copolymers with vinyl monomers, and graft-modified products. Examples of wax further include higher aliphatic alcohols; fatty acids, such as stearic acid and palmitic acid; acid amide waxes; ester waxes; hydrogenated castor oil and derivatives thereof; plant waxes; and animal waxes. Among these compounds, in particular, ester waxes and hydrocarbon waxes can be used from the viewpoint of achieving good releasability. In aspects of the present invention, these waxes may be used alone or in combination. The wax content may be in the range of 1 to 40 parts by mass and even 3 to 25 parts by mass with respect to 100 parts by mass of the binder resin. In the case where the wax content falls within the above range, appropriate bleeding properties of wax are obtained during fixation. This prevents the winding of a transfer material even at a high temperature. Furthermore, even if the toner is subjected to stress during development and transfer, wax is less likely to be exposed at the surface of each toner particle. It is thus possible to achieve the uniform chargeability of each toner particle.

Examples of the binder resin for use in the toner according to aspects of the present invention include copolymers of styrene-based monomers, such as styrene, o-methylstyrene, m-methylstyrene, p-methylstyrene, p-methoxystyrene, and p-ethylstyrene, and polymerizable acrylic-based monomers, such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dibutyl phosphate ethyl acrylate, and 2-benzoyloxyethyl acrylate. Furthermore, polyvinyl acetate, a silicone resin, a polyester resin, a polyamide resin, a furan resin, an epoxy resin, or a xylene resin may be used in addition to the binder resin.

The styrene-acrylic-based copolymer may be cross-linked. Examples of a crosslinking agent include aromatic divinyl compounds, such as divinylbenzene and divinylnaphthalene; carboxylic acid esters each having two double bonds, such as ethylene glycol diacrylate, ethylene glycol dimethacrylate, and 1,3-butanediol dimethacrylate; divinyl compounds, such as divinylaniline, divinyl ether, divinyl sulfide, and divinyl sulfone; and compounds each having three or more vinyl groups. These crosslinking agents may be used alone or in combination as a mixture. Examples of a method for synthesizing the styrene-acrylic-based copolymer include bulk polymerization, solution polymerization, suspension polymerization, and emulsion polymerization. The glass transition temperature (Tg) of the binder resin may be in the range of 45° C. to 65° C. and even 50° C. to 55° C.

The toner according to aspects of the present invention contains a colorant. Examples of the colorant include organic pigments and dyes and inorganic pigments described below.

As pigments used for cyan colorants, a copper phthalocyanine compound and derivatives thereof, anthraquinone compounds, basic dye lake compounds may be used. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Pigments used for magenta colorants include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Pigments used for yellow colorants include condensed azo compounds, isoindolinone compounds, anthraquinone compounds, azo metal complexes, methine compounds, and allylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

Black colorants include carbon black, magnetic substances, and black colorants subjected to tone adjustment by the foregoing yellow, magenta, and cyan colorants.

These colorants may be used alone, in combination as a mixture, or in the form of a solid solution. The colorant for use in the toner according to aspects of the present invention is selected in terms of a hue angle, saturation, brightness, light fastness, OHP transparency, and dispersibility in the toner. The amount of the colorant added can be in the range of 1 part by mass to 20 parts by mass with respect to 100 parts by mass of the binder resin. The toner according to aspects of the present invention may be formed into a magnetic toner by the incorporation of a magnetic substance serving as a colorant. The magnetic substance may have a number-average particle size of 2 μm or less and even 0.1 μm to 0.5 μm. The magnetic substance content may be in the range of 20 parts by mass to 200 parts by mass and even 40 parts by mass to 150 parts by mass with respect to 100 parts by mass of the polymerizable monomer or the binder resin.

The toner according to aspects of the present invention may be produced by optionally mixing the toner particles with a charge control agent. The incorporation of the charge control agent makes it possible to stabilize charging characteristics and control the degree of triboelectric charging in response to a development system. Any known charge control agent may be used. In particular, a charge control agent that has a triboelectric charging speed and is capable of stably maintaining a certain amount of triboelectric charge can be used. Examples of a charge control agent that permits the toner to be negatively chargeable include organometallic compounds, chelate compounds, monoazo metal compounds, metal acetylacetonate compounds, metal compounds of aromatic oxycarboxylic acid, aromatic dicarboxylic acid, oxycarboxylic acid, and dicarboxylic acid, aromatic oxycarboxylic acid, aromatic mono- and poly-carboxylic acids, metal salts thereof, anhydrides, esters, phenol derivatives, such as bisphenol, urea derivatives, metal-containing salicylic acid compounds, metal-containing naphthoic acid compounds, boron compounds, quaternary ammonium salts, calixarene, and resin-based charge control agents.

Examples of a charge control agent that permits the toner to be positively chargeable include guanidine compounds; imidazole compounds; quaternary ammonium salts, such as tributylbenzylammonium-1-hydroxy-4-naphthosulfonic acid and tetrabutylammonium tetrafluoroborate, onium salts, such as phosphonium salts that are analogs thereof, and lake pigments thereof; triphenylmethane dyes and lake pigments thereof (examples of a laking agent include phosphotungstic acid, phosphomolybdic acid, phosphotungstomolybdic acid, tannic acid, lauric acid, gallic acid, ferricyanide, and ferrocyanide); metal salts of higher fatty acid; and resin-based charge control agents.

These charge control agents may be used alone or in combination. Among these charge control agents, a metal-containing salicylic acid-based compound can be used from the viewpoint of achieving good rise properties of charging and charging stability. In particular, the metal can be aluminum or zirconium. As the charge control agent, aluminum 3,5-di-tert-butylsalicylate compound can be used. The charge control agent content may be in the range of 0.01 parts by mass to 5 parts by mass and even 0.05 parts by mass to 4.5 parts by mass with respect to 100 parts by mass of the binder resin.

The toner according to aspects of the present invention can contain a charge control resin in such a manner that the charge-retaining ability is supplemented by the charge control resin. Examples of the charge control resin that can be used include polymers each containing a sulfonic acid group, a sulfonate group, or a sulfonic acid ester group in a side chain. Among these polymers, in particular, polymers and copolymers prepared by polymerization of monomers each containing a sulfonic acid group, a sulfonate group, or a sulfonic acid ester group can be used.

Examples of the monomers each containing a sulfonic acid group, a sulfonate group, or a sulfonic acid ester group used for the production of the charge control resin include styrenesulfonic acid, 2-acrylamido-2-methylpropanesulfonic acid, 2-methacrylamido-2-methylpropanesulfonic acid, vinylsulfonic acid, methacrylsulfonic acid, and alkyl esters thereof.

Polymers each containing a sulfonic acid group, a sulfonate group, or a sulfonic acid ester group used may be a homopolymer of any monomer described above or may be a copolymer of any monomer described above and any other monomer. As a monomer that can be copolymerized with any monomer described above to form a copolymer, a polymerizable vinyl-based monomer is exemplified. A monofunctional polymerizable monomer or a polyfunctional polymerizable monomer, which is exemplified in the description of the binder resin, can be used.

The polymer containing a sulfonic acid group or the like may be contained in an amount of 0.01% by mass to 5.0% by mass and even 0.1% by mass to 3.0% by mass with respect to 100 parts by mass of the polymerizable monomer or the binder resin. In the case where the proportion of the polymer containing a sulfonic acid group or the like falls within the above range, the effect of stabilizing the charge of the toner particles is sufficiently provided, thereby resulting in excellent environmental characteristics and durability.

To improve charge stability, developability, flowability, and durability, the toner according to aspects of the present invention can contain an inorganic fine powder, such as a silica, alumina, or titania fine powder. Silica can be used as a main component of the inorganic fine powder added. The silica fine powder can have a number-average primary particle size of 4 nm to 80 nm. In the case where the number-average primary particle size falls within the above range, the toner has improved flowability and satisfactory storage stability. The number-average primary particle size of the inorganic fine powder is determined by observation with a scanning electron microscope (SEM) and measuring the particle size of 100 particles of the inorganic fine powder in the field of view of the SEM. In addition, the silica fine powder and a fine powder composed of titanium oxide, alumina, or a double oxide thereof can be used in combination. Among inorganic fine powders in combination with silica, titanium oxide can be used.

The inorganic fine powder is added to improve the flowability of the toner and uniformity in the triboelectric charging of the toner particles. Hydrophobic treatment of the inorganic fine powder imparts the functions of, for example, adjusting the amount of triboelectric charge of the toner, improving environmental stability, and improving properties in a high-humidity environment to the inorganic fine powder. So, an inorganic fine powder subjected to hydrophobic treatment can be used. Absorption of water by the inorganic fine powder added to the toner reduces the amount of triboelectric charge of the toner and is liable to cause reductions in developability and transferability. Examples of an agent that can be used for the hydrophobic treatment of the inorganic fine powder include unmodified silicone varnishes, various modified silicone varnishes, unmodified silicone oils, various modified silicone oils, silane compounds, silane coupling agents, other organic silicon compounds, and organic titanium compounds. These agents may be used alone or in combination.

An inorganic fine powder treated with a silicone oil can be used. In particular, in the case where an inorganic fine powder is subjected to hydrophobic treatment using a coupling agent and silicone oil treatment using a silicone oil in one operation or where an inorganic fine powder is subjected to hydrophobic treatment using a coupling agent and then silicone oil treatment using a silicone oil, the resulting hydrophobic inorganic fine powder can maintain a large amount of triboelectric charge even in a high-humidity environment, there by reducing selective development.

Examples of a method for producing toner particles in an aqueous dispersion medium include an emulsion aggregation method in which aggregates are formed from an emulsion in an aqueous dispersion medium, the emulsion containing essential components to form toner particles; a suspension granulation method including dissolving components essential for the toner in an organic solvent, performing granulation in an aqueous dispersion medium, and evaporating the organic solvent; a suspension polymerization method and an emulsion polymerization method including directly granulating a polymerizable monomer that contains component essential for the toner dissolved therein in an aqueous dispersion medium and then performing polymerization; a method including forming an outer layer on each toner particle by seed polymerization after suspension polymerization or emulsion polymerization; and a microcapsule method typified by interfacial polycondensation or submerged drying.

Among these methods, a suspension polymerization method can be employed. In the suspension polymerization method, wax and the colorant (optionally, in addition, a polymerization initiator, a crosslinking agent, a charge control agent, and any other additive) are uniformly dissolved or dispersed in polymerizable monomers to form a polymerizable monomer composition. The polymerizable monomer composition is dispersed in an aqueous dispersion medium containing a dispersion stabilizer with an appropriate stirrer. The resulting mixture is subjected to a polymerization reaction, thereby producing toner particles having a predetermined particle size. After the completion of the polymerization, the toner particles are filtrated, washed, and dried. The toner particles are mixed with an inorganic fine powder in such a manner that the inorganic fine powder is attached to the surface of each toner particle, thereby producing a toner. For the toner produced by the suspension polymerization method, highly hydrophobic wax is likely to be located in the core of each toner particle, so that the toner can have high durability.

Examples of an oil-soluble polymerization initiator used in the polymerization described above include azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropylperoxy carbonate, decanoyl peroxide, lauroyl peroxide, stearoyl peroxide, propionyl peroxide, acetyl peroxide, tert-butylperoxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, and cumene hydroperoxide.

Furthermore, the toner particles according to aspects of the present invention can be subjected to surface treatment by the addition of a water-soluble polymerization initiator to an aqueous medium after the production of the toner particles in the aqueous medium. The addition of the water-soluble polymerization initiator to the aqueous medium causes the polymerization of the resin located on the surface of each toner particle, thereby improving the durability, in particular, the durability after exposure to a high temperature of the toner without reducing the low-temperature fixability. Examples of the water-soluble polymerization initiator include ammonium persulfate, potassium persulfate, 2,2'-azobis(N,N'-dimethyleneisobutyroamidine) hydrochloride, 2,2'-azobis(2-amidinopropane) hydrochloride, azobis(isobutylamidine) hydrochloride, sodium 2,2'-azobisisobutyronitrile sulfonate, ferrous sulfate, and hydrogen peroxide.

Any of known inorganic and organic dispersants can be used as a dispersant used in the preparation of the aqueous dispersion medium. Specific examples of the inorganic dispersant include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Specific examples of the organic dispersant include polyvinyl alcohol, gelatin, methyl cellulose, methylhydroxypropyl cellulose, ethyl cellulose, sodium salts of carboxymethyl cellulose, and starch. A commercially available nonionic, anionic, or cationic surfactant can be used. Examples of the surfactant include sodium dodecylbenzenesulfonate, sodium dodecyl sulfate, sodium tetradecyl sulfate, sodium pentadecyl sulfate, sodium octyl sulfate, sodium oleate, sodium laurate, potassium stearate, and calcium oleate.

As a dispersant used in the preparation of the aqueous dispersion medium, an inorganic dispersant that is poorly soluble in water can be used. Furthermore, an inorganic dispersant that is poorly soluble in water and is soluble in an acid can be used. In the case where an aqueous dispersion medium is prepared using the inorganic dispersant that is poorly soluble in water, the amount of the dispersant used can be in the range of 0.2 parts by mass to 2.0 parts by mass with respect to 100 parts by mass of the polymerizable monomer. The aqueous dispersion medium can be prepared using 300 parts by mass to 3000 parts by mass of water with respect to 100 parts by mass of the polymerizable monomer composition. In the case of producing the aqueous dispersion medium containing the inorganic dispersant that is poorly soluble in water, a commercially available dispersant may be dispersed as it is. To obtain dispersant particles having a fine, uniform particle size, an aqueous dispersion medium may be prepared by forming the inorganic dispersant that is poorly soluble in water in a liquid medium, such as water, under high-speed stirring. For example, in the case where tricalcium phosphate is used as a dispersant, an aqueous solution of sodium phosphate and an aqueous solution of calcium chloride can be mixed under high-speed stirring to form fine particles of tricalcium phosphate.

The toner according to aspects of the present invention may be used as a two-component developer containing the toner and a carrier. Any of known carriers may be used as a carrier for use in a two-component development method. Specific examples thereof include particles composed of metals, such as surface oxidized or unoxidized iron, nickel, cobalt, manganese, chromium, and rare earth elements, alloys thereof, and oxides thereof, the particles having an average particle size of 20 to 300 μm. Furthermore, particles produced by attaching a resin, for example, a styrene-based resin, an acrylic-based resin, silicone-based resin, a fluorinated resin, or a polyester resin, to surfaces of carrier particles, can be used. Alternatively, particles produced by covering carrier particles with the resin can be used.

Methods for measuring physical properties in aspects of the present invention will be described below.

[1] Measurement of Mw and Mz of Carboxy-Containing Styrene-based Resin

The molecular-weight distribution of a carboxy-containing styrene-based resin is measured by gel permeation chromatography (GPC) as described below.

A carboxy-containing styrene-based resin is mixed with THF in a concentration of 5 mg/mL. The mixture is allowed to stand at room temperature for 5 hours, sufficiently shaken and mixed with THF, and allowed to stand at room temperature for another 24 hours. The mixture is passed through a sample treatment filter (Maishori Disk H-25-2, manufactured by Tosoh Corporation, or Ekicrodisc 25CR, manufactured by Gelman Science Japan Co., Ltd.). The resulting filtrate is used as a sample for GPC.

The molecular weight distribution of a prepared sample is measured with a GPC measuring apparatus (HLC-8210 GPC, manufactured by Tosoh Corporation) in accordance with the operation manual of the system under measurement conditions to determine Mw and Mz.

Measurement Conditions

Apparatus: High-speed GPC "HLC-8120 GPC" (manufactured by Tosoh Corporation)

Column: A series of seven columns Shodex KF-801, 802, 803, 804, 805, 806, and 807 (manufactured by Showa Denko K.K.)

Temperature: 135.0° C.

Solvent: o-dichlorobenzene (containing 0.10 wt/vol % BHT) for gel chromatography Eluent: THF Flow rate: 1.0 mL/min Oven temperature: 40.0° C.

Amount injected: 0.10 mL

In addition, upon calculation of the molecular weight of the sample, a molecular weight calibration curve prepared with a standard polystyrene resin (for example, trade name: TSK Standard Polystyrene F-850, F-450, F-288, F-128, F-80, F-40, F-20, F-10, F-4, F-2, F-1, A-5000, A-2500, A-1000, or A-500, manufactured by Tosoh Corporation) is used.

[2] Weight-Average Particle Size (D4) of Toner

The weight-average particle size of the toner (D4) is calculated as described below. A precision grain size distribution measuring apparatus based on a pore electrical resistance method, "COULTER COUNTER MULTISIZER 3" (registered trademark, manufactured by Beckman Coulter, Inc.), is used as a measuring apparatus. Dedicated software included with the apparatus "BECKMAN COULTER MULTISIZER 3 Version 3.51" (manufactured by Beckman Coulter, Inc.) is used for setting measurement conditions and analyzing measurement data. Note that the measurement is performed while the number of effective measurement channels is set to 25,000.

An aqueous electrolyte solution prepared by dissolving reagent grade sodium chloride in ion-exchanged water in a concentration of about 1% by mass, for example, an "ISOTON II" (manufactured by Beckman Coulter, Inc.), can be used as an aqueous electrolyte solution to be used in the measurement.

Note that the dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle size of 10.0 μm" (manufactured by Beckman Coulter, Inc.) is set as a Kd value. A threshold and a noise level are automatically set by pressing a "threshold/noise level measurement" button. In addition, a current is set to 1,600 μA, a gain is set to 2, and an aqueous electrolyte solution is set to an ISOTON II, and a check mark is placed in a check box as to whether the aperture tube is flushed after the measurement.

In the "setting for conversion from pulse to particle size" screen of the dedicated software, a bin interval is set to a logarithmic particle size, the number of particle size bins is set to 256, and a particle size range is set to the range of 2 μm to 60 μm.

A specific measurement method is as described below.

(1) About 200 mL of the aqueous electrolyte solution is charged into a 250-mL round-bottom beaker composed of glass dedicated for the MULTISIZER 3. The beaker is set in a sample stand, and the aqueous electrolyte solution in the beaker is stirred with a stirrer rod at 24 rotations/sec in a counterclockwise direction. Then, dirt and bubbles in the aperture tube are removed by the "aperture flush" function of the dedicated software.

(2) About 30 mL of the aqueous electrolyte solution is charged into a 100-mL flat-bottom beaker composed of glass. About 0.3 mL of a diluted solution prepared by diluting a "CONTAMINON N" (a 10% by mass aqueous solution of a neutral detergent for washing a precision measuring device, the detergent containing a nonionic surfactant, an anionic surfactant, and an organic builder and having a pH of 7, manufactured by Wako Pure Chemical Industries, Ltd.) with ion-exchanged water by about 3-fold by mass is added as a dispersant to the aqueous electrolyte solution.

(3) An ultrasonic dispersing unit "ULTRASONIC DISPERSION SYSTEM TETRA 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 mL of the CONTAMINON N is charged into the water tank.

(4) The beaker in section (2) is set in the beaker fixing hole of the ultrasonic dispersing unit. The ultrasonic dispersing unit is operated. Then, the height position of the beaker is adjusted in such a manner that the liquid level of the aqueous electrolyte solution in the beaker resonates with an ultrasonic wave to the maximum extent possible.

(5) About 10 mg of toner is gradually added to and dispersed in the aqueous electrolyte solution in the beaker in section (4) while the aqueous electrolyte solution is irradiated with the ultrasonic wave. Then, the ultrasonic dispersion treatment is continued for additional 60 seconds. Note that the temperature of water in the water tank is appropriately adjusted so as to be 10° C. to 40° C.

(6) The aqueous electrolyte solution in section (5) in which the toner is dispersed is dropped with a pipette to the round-bottom beaker in section (1) placed in the sample stand, and the concentration of the toner to be measured is adjusted to about 5%. Then, measurement is performed until 50,000 particles are measured.

(7) The measurement data is analyzed with the dedicated software included with the apparatus, and the weight-average particle size (D4) is calculated. Note that an "average size" on the "analysis/volume statistics (arithmetic average)" screen of the dedicated software when the dedicated software is set to show a graph in a vol % unit is the weight-average particle size (D4).

[3] Viscosity of Toner at 100° C.

Measurement is performed with a Flow Tester CFT-500D (manufactured by Shimadzu Corporation) in accordance with the operation manual of the apparatus under the following conditions. Note that the viscosities of toner are measured in the temperature range of 50° C. to 200° C. to determine the viscosity of the toner at a temperature of 100° C.

Sample: 1.0 g of the toner is weighed and molded into a sample with a pressure molder.

Die hole diameter: 1.0 mm

Die length: 1.0 mm

Cylinder pressure: $9.807\times10^5$ (Pa)

Measurement mode: Temperature increase method

Rate of temperature increase: 4.0° C./min

The viscosities (Pa·s) of the toner in the temperature range of 50° C. to 200° C. are measured by the method described above, and the viscosity (Pa·s) at 100° C. is determined from expression:

$$\eta'=TW'/DW'=\pi PR4/8LQ \text{ (Pa·s)}$$

where

TW' (apparent shear stress at tube wall)=PR/2L ($N/m^2$)

DW' (apparent shear rate at tube wall)=4Q/πR3 ($sec^{-1}$)

η': viscosity (Pa·s)

Q: exit velocity ($m^3$/sec)

P: extrusion pressure ($N/m^2$)

R: diameter of nozzle (m)

L: length of nozzle (m)

[4] Measurement of Cyclohexane-Insoluble Matter by Soxhlet Extraction of Toner

A 200-mL flat-bottom flask is equipped with a Soxhlet extractor (extraction thimble size: 28×100 mm). A Dimroth condenser is attached to the extractor. Then 1.0 g of a toner is weighed [W1 (g)], placed in an extraction thimble (No. 86R, size: 28×100 mm, manufactured by Toyo Roshi Kaisha, Ltd), and set in the Soxhlet extractor. As a solvent, 200 mL of cyclohexane is used. The flask is heated in an oil bath. With respect to the extraction time, after the solvent begins to reflux by heat, the time an extract is first returned from the extractor to the flat-bottom flask is defined as a starting point. The time the flat-bottom flask is removed from the oil bath is defined as an end point. The temperature of the oil bath is controlled in such a manner that the extraction cycle of the solvent is once every 5 minutes. After the completion of the extraction, the extraction thimble is taken out, air-dried, and dried in vacuo at 40° C. for 8 hours. The extract residue is weighed [W2 (g)]. The mass [W3 (g)] of incineration ash in the toner is determined. The mass of the incineration ash is determined through the following procedure. About 2 g of a sample is placed in a 30-mL porcelain crucible that has been accurately weighed in advance. The crucible containing the sample is accurately weighed to determine the mass [Wa (g)] of the sample. The crucible is placed in an electric furnace, heated at about 900° C. for about 3 hours, left standing to cool in the electric furnace, and left standing to cool at room temperature in a desiccator for 1 hour or longer before the mass of the crucible is accurately weighed. The mass [Wb (g)] of the incineration ash is determined from the following expression:

$$(Wb/Wa)\times100=\text{incineration ash content (\% by mass)}.$$

The mass [W3 (g)] of the incineration ash of the sample is determined from the incineration ash content using the following expression:

$$W3=W1\times[\text{incineration ash content (\% by mass)}] \text{ (g)}.$$

Cyclohexane-insoluble matter is determined from the following expression:

$$\text{Cyclohexane-insoluble matter}=[W2-W3]/[W1-W3]\times100(\%).$$

Cyclohexane-insoluble matter at an extraction time of 4 hours is referred to as insoluble matter A (%). Cyclohexane-insoluble matter at an extraction time of 24 hours is referred to as insoluble matter B (%).

[5] Measurement of Acid Value Av (mg KOH/g)

In aspects of the present invention, the acid value Av of the carboxy-containing styrene-based resin is measured by the following method in accordance with JIS K 0070-1992. The same is true of the acid value of a polyester resin.

Sample Preparation

First, 1.0 g of a sample is accurately weighed and charged into a 200-mL beaker. The sample is dissolved in 120 mL of toluene while stirring with a stirrer. Furthermore, 30 mL of ethanol is added thereto. Note that the accurate weight of the sample is referred to as W (g).

Apparatus

An automatic potentiometric titrator (AT-400WIN, manufactured by Kyoto Electronics Manufacturing Co., Ltd.) is used for the measurement. With respect to the setting of the apparatus, a sample soluble in an organic solvent is measured. A glass electrode and a reference electrode that can be used in an organic solvent are used. As a pH glass electrode, for example, an electrode (product code: #100-H112, manufactured by Kyoto Electronics Manufacturing Co., Ltd.) is used. Note that the tip of the electrode should not be dried. As a cork-type reference electrode, an electrode (product code: #100-R115 (manufactured by Kyoto Electronics Manufacturing Co., Ltd.) is used. Note that the tip of the electrode should not be dried. Be sure to check that the electrode is filled with an internal solution to the extent that the internal solution reaches an inlet. As the internal solution, a 3.3 M KCl solution is used.

Procedure

The prepared sample is placed in an autosampler of the apparatus. The electrodes are immersed in the sample solution. A titrant (1/10 N KOH (ethanol solution)) is set above the sample solution. Then 0.05-mL portions of the titrant are added dropwise by automatic intermittent titration, and an acid value is calculated. Here, the amount of the KOH solution used is referred to as S (mL). A blank is also measured. The amount of the KOH solution used at this time is referred to as B (mL). An acid value is calculated with the following expression from the obtained result:

$$\text{Acid value (mg KOH/g)}=\{(S-B)\times f\times5.61\}/W$$

where f represents a factor of KOH.

[6] Measurement of Hydroxyl Value OHv (mg KOH/g)

In aspects of the present invention, the hydroxyl value OHv (JIS hydroxyl value) of the carboxy-containing styrene-based resin is determined by a method described below. The hydroxyl value indicates the number of milligrams of potassium hydroxide required to neutralize acetic acid bonded to a hydroxyl group when 1 g of a sample is acetylated. The hydroxyl value of the binder resin is measured in accordance with JIS K 0070-1992. Specifically, measurement is performed by the following procedure.

(i) Preparation of Reagent

Into a 100-mL volumetric flask, 25 g of reagent grade acetic anhydride is charged. Pyridine is added in such a manner that the total volume is adjusted to 100 mL. The mixture is sufficiently shaken to prepare an acetylating reagent. The resulting acetylating reagent is stored in a brown bottle to protect the reagent from moisture, carbon dioxide, and so forth. Next, 1.0 g of phenolphthalein is dissolved in 90 mL of ethyl alcohol (95% by volume). Ion exchanged water is added in such a manner that the total volume is adjusted to 100 mL, thereby preparing a phenolphthalein solution. Then 35 g of potassium hydroxide (reagent grade) is dissolved in 20 mL of water. Ethyl alcohol (95% by volume) is added in such a manner that the total volume is adjusted to 1 L. The resulting mixture is placed into an alkali-proof vessel to protect the mixture from, for example, carbon dioxide, and is allowed to stand for 3 days. The mixture is then filtered to give a potassium hydroxide solution. The resulting potassium hydroxide solution is stored in an alkali-proof vessel. The factor of the potassium hydroxide solution is determined as follows: Into an Erlenmeyer flask, 25 mL of 0.5 mol/L hydrochloric acid is charged. Several drops of the phenolphthalein solution are added thereto. The hydrochloric acid is titrated with the potassium hydroxide solution. The factor is determined from the amount of the potassium hydroxide solution needed for neutralization. The 0.5 mol/L hydrochloric acid is prepared in accordance with JIS K 8001-1998.

(ii) Operation (A) Main Test

First, 1.0 g of the resin that has been pulverized is accurately weighed in a 200-mL round-bottom flask. To the flask, 5.0 mL of the acetylating reagent is accurately added with a whole pipette. Here, if the sample is not readily dissolved in the acetylating reagent, a small amount of reagent grade toluene is added thereto for dissolution. A small funnel is placed on the mouth of the flask. The bottom portion of the flask is immersed in a glycerol bath at about 97° C., the bottom portion extending from the bottom to a position about 1 cm from the bottom. To prevent an increase in the temperature of the neck of the flask due to the heat of the bath, is covered with a piece of cardboard with a round hole can be attached to the base of the neck of the flask.

After one hour, the flask is taken from the bath and left standing to cool. Then 1 mL of water is added thereto through the funnel. The mixture is shaken to hydrolyze acetic anhydride. To achieve complete hydrolysis, the flask is again heated in the glycerol bath for 10 minutes. After the mixture is left standing to cool, the walls of the funnel and the flask are rinsed with 5 mL of ethyl alcohol. Several drops of the phenolphthalein solution are added thereto as an indicator. The resulting mixture is titrated with the potassium hydroxide solution. The point where the pale red of the indicator is continued for about 30 seconds is regarded as the end point of the titration.

(B) Blank Test

A titration is performed in the same way as in Section "Operation", except that the sample of the binder resin is not used.

(iii) Substituting the Results in the Following Expression Yields a Hydroxyl Value.

$$A=[\{(B-C)\times 28.05\times f\}/S]+D$$

where A represents a hydroxyl value (mg KOH/g), B represents the volume (mL) of the potassium hydroxide solution added in the blank test, C represents the volume (mL) of the potassium hydroxide solution added in the main test, f represents the factor of the potassium hydroxide solution, S represents the weight (g) of the sample, and D represents the acid value (mg KOH/g) of the binder resin.

EXAMPLES

The present invention will be described by examples. In aspects of the present invention, the number of parts indicates the number of parts by mass.

Production of Carboxy-Containing Styrene-Based Resin 1

Into an autoclave equipped with a pressure-reducing unit, a water separator, a nitrogen gas supply unit, a temperature measuring unit, and a stirrer, 300 parts by mass of xylene (boiling point: 144° C.) was charged. The air inside the autoclave was sufficiently replaced with nitrogen under stirring. Xylene was heated to reflux.

| | |
|---|---|
| Styrene | 93.1 parts by mass |
| Methyl methacrylate | 2.5 parts by mass |
| Methacrylic acid | 1.8 parts by mass |
| 2-Hydroxyethyl methacrylate copolymer | 2.6 parts by mass |
| Initiator: di-tert-butyl peroxide | 2.0 parts by mass |

A mixture of these materials described above was added thereto under the reflux conditions. Polymerization was performed at a polymerization temperature of 170° C. and a pressure of 0.150 MPa during the reaction over a period of 5 hours. A step of removing a solvent was performed for 3 hours under reduced pressure to remove xylene. Pulverization was performed to provide carboxy-containing styrene-based resin 1. Table 1 shows the physical properties of carboxy-containing styrene-based resin 1.

Production of Carboxy-Containing Styrene-Based Resins 2 to 17

Carboxy-containing styrene-based resins 2 to 17 were produced in the same way as carboxy-containing styrene-based resin 1, except that the amounts of the materials fed were changed as shown in Table 1. Table 1 also shows the physical properties of carboxy-containing styrene-based resins 2 to 17.

TABLE 1

| Carboxy-containing styrene-based resin | Styrene | Methyl methacrylate | Methacrylic acid | 2-Hydroxyethyl methacrylate copolymer | Mw | Mz/Mw | Tg (° C.) | Hydroxyl value (mgKOH/g) | Acid value (mgKOH/g) |
|---|---|---|---|---|---|---|---|---|---|
| Styrene-based resin 1 | 93.1 | 2.5 | 1.8 | 2.6 | 17000 | 2.10 | 90 | 12.5 | 12.5 |
| Styrene-based resin 2 | 93.1 | 2.5 | 1.8 | 2.6 | 10200 | 2.15 | 90 | 12.5 | 12.5 |
| Styrene-based resin 3 | 93.1 | 2.5 | 1.8 | 2.6 | 29700 | 2.08 | 90 | 12.5 | 12.5 |
| Styrene-based resin 4 | 94.7 | 2.5 | 0.7 | 2.1 | 17000 | 1.62 | 90 | 10.0 | 5.1 |
| Styrene-based resin 5 | 89.1 | 2.5 | 2.2 | 6.2 | 17000 | 4.99 | 90 | 30.0 | 15.0 |
| Styrene-based resin 6 | 94.3 | 2.5 | 2.2 | 1.0 | 17000 | 1.70 | 90 | 5.0 | 15.0 |
| Styrene-based resin 7 | 90.2 | 2.5 | 1.1 | 6.2 | 17000 | 3.10 | 90 | 30.0 | 7.5 |
| Styrene-based resin 8 | 94.5 | 2.5 | 2.2 | 0.8 | 17000 | 1.70 | 90 | 4.0 | 15.0 |
| Styrene-based resin 9 | 90 | 2.5 | 1.1 | 6.4 | 17000 | 3.10 | 90 | 31.0 | 7.5 |
| Styrene-based resin 10 | 93.7 | 2.5 | 0.7 | 3.1 | 17000 | 1.69 | 90 | 15.0 | 5.0 |
| Styrene-based resin 11 | 92.5 | 2.5 | 3.6 | 1.4 | 17000 | 3.13 | 90 | 6.5 | 25.0 |
| Styrene-based resin 12 | 93.8 | 2.5 | 0.6 | 3.1 | 17000 | 1.69 | 90 | 15.0 | 4.0 |
| Styrene-based resin 13 | 92.4 | 2.5 | 3.7 | 1.4 | 17000 | 3.13 | 90 | 6.5 | 26.0 |
| Styrene-based resin 14 | 93.1 | 2.5 | 1.8 | 2.6 | 9900 | 2.13 | 90 | 12.5 | 12.5 |

TABLE 1-continued

| Carboxy-containing styrene-based resin | Styrene | Methyl methacrylate | Methacrylic acid | 2-Hydroxyethyl methacrylate copolymer | Mw | Mz/Mw | Tg (° C.) | Hydroxyl value (mgKOH/g) | Acid value (mgKOH/g) |
|---|---|---|---|---|---|---|---|---|---|
| Styrene-based resin 15 | 93.1 | 2.5 | 1.8 | 2.6 | 30100 | 2.06 | 90 | 12.5 | 12.5 |
| Styrene-based resin 16 | 94.6 | 2.5 | 2.9 | 0 | 17000 | 1.60 | 90 | 0.0 | 20.0 |
| Styrene-based resin 17 | 88.9 | 2.5 | 2.4 | 6.2 | 17000 | 5.02 | 90 | 30.0 | 16.5 |

A toner was produced by the following procedure.

Production Example 1 of Toner

First, 2.3 parts of tricalcium phosphate was added to 900 parts of ion exchanged water heated to 60° C. The mixture was stirred with a mixer (Model: TK-homomixer, manufactured by Tokushu Kika Kogyo) at 10,000 rpm, thereby preparing an aqueous medium.

The following materials were dissolved by stirring with a propeller stirrer at 100 rpm to prepare a resin-containing monomer.

| | |
|---|---|
| Styrene | 40.0 parts |
| n-Butyl acrylate | 30.0 parts |
| Carboxy-containing styrene-based resin 1 | 15.0 parts |
| Polyester resin | 5.0 parts |

Furthermore, the following materials were dispersed with an attritor to provide a fine-grained colorant-containing monomer.

| | |
|---|---|
| Styrene | 30.0 parts |
| C.I. Pigment Red 122 | 6.5 parts |
| Charge control agent (BONTRON E-88, manufactured by Orient Chemical Industries, Ltd.) | 1.0 part |

The fine-grained colorant-containing monomer and the resin containing monomer were mixed to form a preparation. The preparation was heated to 60° C. Wax (HNP-10, melting point: 75° C., manufactured by Nippon Seiro Co., Ltd.) (10.0 parts), divinylbenzene (0.20 parts), and a polymerization initiator (2,2'-azobis(2,4-dimethylvaleronitrile), 10.0 parts) were dissolved therein to provide a polymerizable monomer composition. The polymerizable monomer composition was added to the aqueous medium. The mixture was stirred with a mixer (Model: TK-homomixer) at 60° C. and 10,000 rpm for 20 minutes, whereby the mixture was granulated.

The granulated mixture was transferred into a propeller stirrer and subjected to a reaction at 70° C. for 5 hours under stirring at 100 rpm. Then 1.0 part by mass of $K_2S_2O_8$ (KPS), which is a water-soluble polymerization initiator, was added thereto. The mixture was heated to 80° C. and subjected to a reaction for another 5 hours, thereby producing toner particles. After the completion of the polymerization reaction, the resulting slurry containing the particles was cooled to room temperature (25° C.) Hydrochloric acid was added to the slurry to dissolve the calcium phosphate salt. After filtration and washing with water, wet colored particles were obtained.

The resulting particles were dried at 40° C. for 12 hours to provide colored particles. The colored particles were subjected to air classification to adjust the particle size, thereby providing toner particles 1.

Then 1.5 parts of negatively chargeable, hydrophobic silica fine powder (primary particle size: 7 nm, BET specific surface area: 130 $m^2/g$), which serves as a flowability-improving agent and has been treated with dimethylsilicone oil (20% by mass), was added to the toner particles with respect to 100 parts of the resulting toner particles. The resulting mixture was mixed at 3000 rpm for 15 minutes with a Henschel mixer (manufactured by Mitsui Miike Machinery Co., Ltd.) to provide toner 1 having a weight-average particle size (D4) of 6.5 μm. Table 3 shows the physical properties of the toner.

Production Examples 2 to 4, 6 to 21, and 32 to 37 of Toner

Toners 2 to 4, 6 to 21, and 32 to 37 were produced as in Section "Production Example 1 of Toner", except that the type and amount of the carboxy-containing styrene-based resin added and the amount of divinylbenzene added were changed as shown in Table 2. Table 3 also shows the physical properties of the resulting toners.

TABLE 2

| | Carboxy-containing styrene-based resin | | Amount of divinylbenzene | Wax | |
|---|---|---|---|---|---|
| Toner | Resin | Amount added (part by mass) | added (part by mass) | Type of wax | Amount added (part by mass) |
| Toner 1 | Styrene-based resin 1 | 15.0 | 0.20 | HNP-10 | 10.0 |
| Toner 2 | Styrene-based resin 1 | 15.0 | 0.10 | HNP-10 | 10.0 |
| Toner 3 | Styrene-based resin 1 | 15.0 | 0.30 | HNP-10 | 10.0 |
| Toner 4 | Styrene-based resin 1 | 7.1 | 0.20 | HNP-10 | 10.0 |
| Toner 6 | Styrene-based resin 2 | 15.0 | 0.20 | HNP-10 | 10.0 |
| Toner 7 | Styrene-based resin 3 | 15.0 | 0.20 | HNP-10 | 10.0 |
| Toner 8 | Styrene-based resin 4 | 7.1 | 0.20 | HNP-10 | 10.0 |
| Toner 9 | Styrene-based resin 5 | 15.0 | 0.20 | HNP-10 | 10.0 |
| Toner 10 | Styrene-based resin 1 | 10.2 | 0.20 | HNP-10 | 10.0 |
| Toner 11 | Styrene-based resin 1 | 20.0 | 0.20 | HNP-10 | 10.0 |
| Toner 12 | Styrene-based resin 1 | 9.8 | 0.20 | HNP-10 | 10.0 |
| Toner 13 | Styrene-based resin 1 | 20.7 | 0.20 | HNP-10 | 10.0 |
| Toner 14 | Styrene-based resin 6 | 15.0 | 0.20 | HNP-10 | 10.0 |
| Toner 15 | Styrene-based resin 7 | 15.0 | 0.20 | HNP-10 | 10.0 |
| Toner 16 | Styrene-based resin 8 | 15.0 | 0.20 | HNP-10 | 10.0 |

TABLE 2-continued

| Toner | Carboxy-containing styrene-based resin | | Amount of divinylbenzene | Wax | |
|---|---|---|---|---|---|
| | Resin | Amount added (part by mass) | added (part by mass) | Type of wax | Amount added (part by mass) |
| Toner 17 | Styrene-based resin 9 | 15.0 | 0.20 | HNP-10 | 10.0 |
| Toner 18 | Styrene-based resin 10 | 15.0 | 0.20 | HNP-10 | 10.0 |
| Toner 19 | Styrene-based resin 11 | 15.0 | 0.20 | HNP-10 | 10.0 |
| Toner 20 | Styrene-based resin 12 | 15.0 | 0.20 | HNP-10 | 10.0 |
| Toner 21 | Styrene-based resin 13 | 15.0 | 0.20 | HNP-10 | 10.0 |
| Toner 32 | Styrene-based resin 1 | 15.0 | 0.08 | HNP-10 | 10.0 |
| Toner 33 | Styrene-based resin 1 | 15.0 | 0.33 | HNP-10 | 10.0 |
| Toner 34 | Styrene-based resin 14 | 15.0 | 0.20 | HNP-10 | 10.0 |
| Toner 35 | Styrene-based resin 15 | 15.0 | 0.20 | HNP-10 | 10.0 |
| Toner 36 | Styrene-based resin 16 | 7.1 | 0.20 | HNP-10 | 10.0 |
| Toner 37 | Styrene-based resin 17 | 15.0 | 0.20 | HNP-10 | 10.0 |

Production Example 5 of Toner

Toner particles were produced as in Section "Production Example 1 of Toner", except that in the preparation of the resin-containing monomer, the amounts of styrene, carboxy-containing styrene-based resin 1, and the polyester resin fed were changed to 30.0 parts, 31.5 parts, and 2.0 parts, respectively; in the polymerization, the amount of 2,2'-azobis(2,4-dimethylvaleronitrile) fed was changed to 15.0 parts; and $K_2S_2O_8$ (KPS), which is a water-soluble polymerization initiator, was not used.

The toner particles were melt-kneaded with a twin-screw extruder heated to 110° C. The kneaded product was cooled and roughly ground with a hammer mill. The roughly ground product was pulverized with a turbo mill (manufactured by Turbo Industry Co., Ltd.). The resulting pulverized product was subjected to air classification to provide colored particles. The colored particles were subjected to thermal spheroidizing treatment with a spray dryer in a nitrogen atmosphere at 70° C. for 1 hour, followed by cooling to provide toner particles. Then 100 parts of the toner particles were mixed with 1.5 parts of hydrophobic silica fine powder serving as an external additive and having a BET specific surface area of 200 $m^2/g$ and a primary particle size of 12 nm with a Henschel mixer (manufactured by Mitsui Miike Machinery Co., Ltd.) to provide toner 5. Table 3 shows the physical properties of the toner.

Production Example 22 of Toner

Toner 22 was produced as in Section "Production Example 1 of Toner", except that the polyester resin was not used. Table 3 shows the physical properties of the toner.

Production Example 23 of Toner

Toner 23 was produced as in Section "Production Example 1 of Toner", except that the wax was changed from HNP-10 to behenyl behenate (melting point: 72° C.). Table 3 shows the physical properties of the toner.

Production Example 24 of Toner

Toner 24 was produced as in Section "Production Example 1 of Toner", except that the amounts of HNP-10 and 2,2'-azobis(2,4-dimethylvaleronitrile) fed were changed to 6.0 parts and 9.0 parts, respectively. Table 3 shows the physical properties of the toner.

Production Example 25 of Toner

Toner 25 was produced as in Section "Production Example 1 of Toner", except that the wax was changed from HNP-10 to behenyl behenate (melting point: 72° C.) and that the amount of the wax was changed to 10.5 parts. Table 3 shows the physical properties of the toner.

Production Example 26 of Toner

Toner 26 was produced as in Section "Production Example 1 of Toner", except that the amounts of HNP-10 and 2,2'-azobis(2,4-dimethylvaleronitrile) were changed to 6.0 parts and 8.5 parts, respectively. Table 3 shows the physical properties of the toner.

Production Example 27 of Toner

Toner 27 was produced as in Section "Production Example 1 of Toner", except that $K_2S_2O_8$, which is a water-soluble polymerization initiator, was not used. Table 3 shows the physical properties of the toner.

Production Example 28 of Toner

Toner particles were produced as in Section "Production Example 27 of Toner". The toner particles were melt-kneaded with a twin-screw extruder heated to 110° C. The kneaded product was cooled and roughly ground with a hammer mill. The roughly ground product was pulverized with a turbo mill. The resulting pulverized product was subjected to air classification to provide colored particles. The colored particles were subjected to thermal spheroidizing treatment with a spray dryer in a nitrogen atmosphere at 70° C. for 1 hour, followed by cooling to provide toner particles 28.

Then 100 parts of the toner particles were mixed with 1.6 parts of hydrophobic silica fine powder serving as an external additive and having a BET specific surface area of 200 $m^2/g$ and a primary particle size of 12 nm with a Henschel mixer to provide toner 28. Table 3 shows the physical properties of the toner.

Production Example 29 of Toner

Toner 29 was produced as in Section "Production Example 1 of Toner", except that C.I. Pigment Red 122 was changed to C.I. Pigment Yellow 17. Table 3 shows the physical properties of the toner.

Production Example 30 of Toner

Toner 30 was produced as in Section "Production Example 1 of Toner", except that C.I. Pigment Red 122 was changed to C.I. Pigment Blue 15:3. Table 3 shows the physical properties of the toner.

Production Example 31 of Toner

Toner 31 was produced as in Section "Production Example 1 of Toner", except that C.I. Pigment Red 122 was changed to carbon black (DBP oil absorption: 42 cm/100 g, specific surface area: 60 $m^2/g$). Table 3 shows the physical properties of the toner.

TABLE 3

| | Proportion of styrene-acrylic-based resin (% by mass) | Proportion of carboxy-containing styrene-based resin (% by mass) | D4 (μm) | Insoluble matter A (% by mass) | Insoluble matter B (% by mass) | Viscosity (mPa · s) |
|---|---|---|---|---|---|---|
| Toner 1 | 83.5 | 10.9 | 6.5 | 80.0 | 30.0 | 17500 |
| Toner 2 | 83.6 | 10.9 | 6.5 | 70.0 | 22.0 | 12000 |
| Toner 3 | 83.5 | 10.9 | 6.5 | 81.0 | 40.0 | 23000 |
| Toner 4 | 82.5 | 5.5 | 6.5 | 78.5 | 28.7 | 11500 |
| Toner 5 | 86.0 | 22.3 | 6.5 | 80.5 | 31.5 | 18000 |
| Toner 6 | 83.5 | 10.9 | 6.5 | 80.0 | 30.0 | 16700 |
| Toner 7 | 83.5 | 10.9 | 6.5 | 80.0 | 30.0 | 18300 |
| Toner 8 | 82.5 | 5.5 | 6.5 | 80.0 | 30.0 | 11500 |
| Toner 9 | 83.5 | 10.9 | 6.5 | 80.0 | 30.0 | 17500 |
| Toner 10 | 82.9 | 7.7 | 6.5 | 79.3 | 29.5 | 13500 |
| Toner 11 | 84.1 | 14.0 | 6.5 | 80.2 | 30.5 | 22000 |
| Toner 12 | 82.9 | 7.4 | 6.5 | 79.0 | 29.4 | 13000 |
| Toner 13 | 84.2 | 14.4 | 6.5 | 80.3 | 30.6 | 23500 |
| Toner 14 | 83.5 | 10.9 | 6.5 | 80.0 | 30.0 | 17500 |
| Toner 15 | 83.5 | 10.9 | 6.5 | 80.0 | 30.0 | 17500 |
| Toner 16 | 83.5 | 10.9 | 6.5 | 80.0 | 30.0 | 17500 |
| Toner 17 | 83.5 | 10.9 | 6.5 | 80.0 | 30.0 | 17500 |
| Toner 18 | 83.5 | 10.9 | 6.5 | 80.0 | 30.0 | 17500 |
| Toner 19 | 83.5 | 10.9 | 6.5 | 80.0 | 30.0 | 17500 |
| Toner 20 | 83.5 | 10.9 | 6.5 | 80.0 | 30.0 | 17500 |
| Toner 21 | 83.5 | 10.9 | 6.5 | 80.0 | 30.0 | 17500 |
| Toner 22 | 86.6 | 11.0 | 6.5 | 80.0 | 30.0 | 15500 |
| Toner 23 | 83.5 | 10.9 | 6.5 | 80.0 | 30.0 | 10000 |
| Toner 24 | 86.0 | 11.2 | 6.5 | 78.5 | 27.7 | 24900 |
| Toner 25 | 83.2 | 10.9 | 6.5 | 79.2 | 29.2 | 9850 |
| Toner 26 | 86.0 | 11.2 | 6.5 | 78.4 | 27.5 | 25200 |
| Toner 27 | 83.5 | 10.9 | 6.5 | 78.0 | 28.0 | 17000 |
| Toner 28 | 83.5 | 10.9 | 6.5 | 76.0 | 26.0 | 17000 |
| Toner 29 | 83.5 | 10.9 | 6.5 | 80.0 | 30.0 | 17500 |
| Toner 30 | 83.5 | 10.9 | 6.5 | 80.0 | 30.0 | 17500 |
| Toner 31 | 83.5 | 10.9 | 6.5 | 80.0 | 30.0 | 17500 |
| Toner 32 | 83.6 | 10.9 | 6.5 | 69.0 | 21.0 | 11500 |
| Toner 33 | 83.4 | 10.9 | 6.5 | 84.3 | 41.0 | 23500 |
| Toner 34 | 83.5 | 10.9 | 6.5 | 80.0 | 30.0 | 16500 |
| Toner 35 | 83.5 | 10.9 | 6.5 | 80.0 | 30.0 | 18500 |
| Toner 36 | 82.5 | 5.5 | 6.5 | 80.0 | 30.0 | 11500 |
| Toner 37 | 83.5 | 10.9 | 6.5 | 80.0 | 30.0 | 17500 |

Example 1

The following evaluations were performed using toner 1. Table 4 shows the evaluation results.

(1) Blocking Resistance

Into a 100-mL polymer cup, 10 g of the toner was charged. The toner was left standing at 57° C. for 3 days. The degree of aggregation of the toner was visually evaluated according to the criteria described below.

A: No aggregate was observed.

B: Aggregates are observed but easily disintegrated.

C: Aggregates are observed but disintegrated by shaking the polymer cup.

D: Aggregate can be grasped and not readily disintegrated.

(2) Low-Temperature Fixability

The fixing unit of a commercially available laser beam printer (Model: LBP9500C, manufactured by CANON KABUSHIKI KAISHA) was taken out and modified into an external fixing unit that was capable of adjusting the fixing temperature to a predetermined value and that had a process speed of 360 mm/sec. Plain paper (75 g/m$^2$) was used. After five solid white images were formed, developed, unfixed solid black images (toner laid-on level: 0.6 mg/cm$^2$) were fixed. Here, the unfixed solid black images were fixed while the temperature of the fixing unit was increased from 140° C. to 200° C. in increments of 5° C. Each of the resulting solid black images was rubbed five times with lens-cleaning paper under a load of about 100 g. The temperature at which the rate of decrease in the image density before and after rubbing was 10% or less was defined as a fixing temperature. In the case where the temperature is lower, the toner has better low-temperature fixability.

A: The fixing temperature is less than 160° C.

B: The fixing temperature is 160° C. or more and below 165° C.

C: The fixing temperature is 165° C. or more and below 170° C.

D: The fixing temperature is 170° C. or more.

(3) Winding Property at Low Temperature

The feeding of paper was visually checked during the evaluation of Section (2). The temperature of the fixing unit when paper was fed without winding was studied. The winding properties were evaluated according to the criteria described below. In the case where the temperature is lower, the toner has better winding properties at a low temperature.

A: less than 150° C.

B: 150° C. or more and less than 155° C.

C: 155° C. or more and less than 160° C.

D: 160° C. or more (4) Toner Deterioration

Toner 1 was a nonmagnetic toner serving as a one-component developer. A modified machine of a commercially available laser printer (LBP-5400, manufactured by CANON KABUSHIKI KAISHA) was used as an image-forming apparatus. Toner deterioration was evaluated using color laser copier paper (manufactured by CANON KABUSHIKI KAISHA, 80 g/m$^2$) at 23° C. and a relative humidity of 50%. The evaluation machine was modified so as to have a process speed of 240 mm/sec by changing the gears and software.

A cyan cartridge was used for the evaluation. That is, a commercial toner was removed from a commercially available cyan cartridge. The inside of the cartridge was cleaned with an air blower. The cartridge was charged with 150 g of Toner 1 according to aspects of the present invention. Then the evaluation was performed. Magenta, yellow, and black cartridges in which commercial toners were removed and in which mechanisms for detecting the amounts of toners remaining were cancelled were mounted on the respective magenta, yellow, and black stations.

Under the foregoing conditions, 15,000 images each having a page coverage of 0.5% were formed in an intermittent mode (that is, a mode in which a developing unit is suspended for 10 seconds after each print is made and in which the deterioration of the toner is facilitated by the preliminary action of a developing apparatus at the time of a restart of the developing apparatus). Solid images were formed at the initial stage and after printing 15,000 sheets. The image densities of the solid images were measured. The rate of change in density was calculated from the resulting image densities using the following expression. The evaluation was performed according to the criteria described below.

Rate of change in density (%)=(density of solid image after printing 15,000 sheets/density of initial solid image)×100

A: The rate of change in density (%) is 95% or more.
B: The rate of change in density (%) is 85% or more and less than 95%.
C: The rate of change in density (%) is 75% or more and less than 85%.
D: The rate of change in density (%) is less than 75%.

(5) Charging Uniformity

Printing was performed as in Section (4). The particle size distribution of the toner in the cartridge at the initial stage and after printing 15,000 sheets was measured in accordance with the method for measuring a weight-average particle size (D4). The rate of change in particle size was calculated from the resulting weight-average particle size (D4) using the following expression. The evaluation was performed according to the criteria described below. Note that a more uniform charge distribution of the toner results in a more uniform consumption of different sized particles of the toner, thereby reducing the rate of change in weight-average particle size (D4).

Rate of change in particle size (%)=(initial weight-average particle size (*D*4)/weight-average particle size (*D*4) after printing 15,000 sheets)×100

A: The rate of change in particle size (%) is 95% or more.
B: The rate of change in particle size (%) is 85% or more and less than 95%.
C: The rate of change in particle size (%) is 75% or more and less than 85%.
D: The rate of change in particle size (%) is less than 75%.

(6) Member Contamination

Printing was performed as in Section (4). The adhesion state of the toner and an external additive to the surface of a developer carrying member after printing 15,000 sheets and the effect on the resulting image were visually observed. The evaluation was performed according to the criteria described below.

A: No adhesion to the developer carrying member is observed.
B: Although a low degree of adhesion to the developer carrying member is observed, an image is less affected.
C: Adhesion to the developer carrying member is observed and slightly causes the unevenness of an image.
D: A high degree of adhesion to the developer carrying member is observed and causes the unevenness of an image.

(7) Fog

First, 15,000 sheets were printed as in Section (4), except that the temperature and the relative humidity were changed to 30° C. and 70%, respectively. With respect to the measurement of a fog, the reflectance of standard paper and a non-image area of a printed sheet after printing 15,000 sheets was measured with a reflection densitometer (Reflectometer Model: TC-6DS, manufactured by TokyoDenshoku Co., Ltd). A green light filter was used for the measurement. A fog was calculated from the measurement results using the following expression and evaluated in accordance with the criteria described below.

Fog (reflectance: %)=reflectance (%) of standard paper−reflectance (%) of non-image area of sample A: The fog is less than 0.5%.
B: The fog is 0.5% or more and less than 1.0%.
C: The fog is 1.0% or more and less than 2.0%.
D: The fog is 2.0% or more.

(8) Incubation Fog

After 15,000 sheets were printed as in Section (7), the printer and the cartridge were left standing in the same environment for 48 hours. Printing was again performed in the same environment. The incubation fog was then evaluated. The incubation fog was measured by the same method as in Section (7) and evaluated in accordance with the criteria described below.

A: The incubation fog is less than 1.5%.
B: The incubation fog is 1.5% or more and less than 2.0%.
C: The incubation fog is 2.0% or more and less than 3.0%.
D: The incubation fog is 3.0% or more.

(9) Toner Deterioration after Exposure to High Temperature

The toner 1 was left standing at 45° C. and a relative humidity of 70% for 2 weeks. Printing was then performed as in Section (4). After printing 15,000 sheets, toner deterioration was evaluated in the same way as Section (4).

Examples 2 to 31

Toners 2 to 31 were evaluated under the same conditions as those in Example 1, except that in the evaluations of the fog and the incubation fog, a blue light filter was used for toner 29 and that an amber light filter was used for toner 30. Table 4 shows the evaluation results.

Comparative Examples 1 to 6

Toners 32 to 37 were evaluated under the same conditions as those in Example 1. Table 4 shows the evaluation results.

TABLE 4

| | | | Durability under normal conditions | | | | | | | Durability after exposure to high temperature |
|---|---|---|---|---|---|---|---|---|---|---|
| | | | N/N | | | | | H/H | | N/N |
| | | | Initial | | After printing 15,000 sheets | | | After printing 15,000 sheets | | After printing 15,000 sheets |
| | Toner | Blocking resistance | Low-temperature Fixability | Winding property | Toner deterioration | Charging uniformity | Member contamination | Fog | Incubation fog | Toner deterioration |
| Example 1 | Toner 1 | A | A | A | A | A | A | A | A | A |
| Example 2 | Toner 2 | A | A | A | A | A | B | A | A | B |
| Example 3 | Toner 3 | A | A | A | A | A | A | A | A | A |
| Example 4 | Toner 4 | A | A | A | A | A | C | A | A | B |
| Example 5 | Toner 5 | A | A | A | A | C | A | A | A | A |
| Example 6 | Toner 6 | A | A | A | A | A | B | A | A | B |
| Example 7 | Toner 7 | A | A | A | A | A | A | A | A | A |
| Example 8 | Toner 8 | A | A | A | B | A | B | A | A | B |
| Example 9 | Toner 9 | A | A | A | A | A | A | A | A | A |
| Example 10 | Toner 10 | A | A | A | A | A | B | A | A | B |
| Example 11 | Toner 11 | A | A | A | A | A | A | A | A | A |
| Example 12 | Toner 12 | A | A | A | B | A | C | A | A | B |
| Example 13 | Toner 13 | A | A | A | A | C | A | A | A | A |
| Example 14 | Toner 14 | A | A | A | A | A | A | A | A | A |
| Example 15 | Toner 15 | A | A | A | A | A | A | A | A | A |
| Example 16 | Toner 16 | A | A | A | A | A | A | A | C | A |
| Example 17 | Toner 17 | A | A | A | A | A | A | C | B | A |
| Example 18 | Toner 18 | A | A | A | A | A | A | A | A | A |
| Example 19 | Toner 19 | A | A | A | A | A | A | A | A | A |
| Example 20 | Toner 20 | A | A | A | A | A | A | A | C | A |
| Example 21 | Toner 21 | A | A | A | A | A | A | C | B | A |
| Example 22 | Toner 22 | C | A | A | A | A | A | A | A | A |
| Example 23 | Toner 23 | A | A | A | A | A | A | A | A | B |
| Example 24 | Toner 24 | A | A | A | A | A | A | A | A | A |
| Example 25 | Toner 25 | A | A | A | B | A | C | A | A | B |
| Example 26 | Toner 26 | A | B | C | A | A | A | A | A | A |
| Example 27 | Toner 27 | A | A | A | A | A | B | A | A | C |
| Example 28 | Toner 28 | A | A | A | C | A | C | A | A | C |
| Example 29 | Toner 29 | A | A | A | A | A | A | A | A | A |
| Example 30 | Toner 30 | A | A | A | A | A | A | A | A | A |
| Example 31 | Toner 31 | A | A | A | A | A | A | A | A | A |
| Comparative Example 1 | Toner 32 | A | A | A | D | A | D | A | A | D |
| Comparative Example 2 | Toner 33 | A | D | D | A | A | A | A | A | A |
| Comparative Example 3 | Toner 34 | A | A | A | D | A | D | A | A | D |
| Comparative Example 4 | Toner 35 | A | D | C | A | A | A | A | A | A |
| Comparative Example 5 | Toner 36 | D | A | A | D | A | D | A | A | D |
| Comparative Example 6 | Toner 37 | A | D | C | A | A | A | A | A | A |

The Examples thus show that aspects of the present invention may provide a toner having excellent blocking resistance, low-temperature fixability, and durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-093351 filed Apr. 14, 2010, which is hereby incorporated by reference herein in its entirety.

What is claimed is:

1. A toner comprising:

toner particles each containing a binder resin;

a colorant; and a carboxy-containing styrene-based resin;

wherein the toner particles are produced in an aqueous medium; and the toner particles contain 50.0% by mass or more of a styrene-acrylic-based resin component with respect to the total mass of the toner particles;

wherein when a content of cyclohexane insoluble matter in the toner after subjecting the toner to a Soxhlet extraction with cyclohexane for 4 hours, is defined as cyclohexane insoluble matter A, and a content of cyclohexane insoluble matter in the toner after subjecting the toner to a Soxhlet extraction with cyclohexane for 24 hours, is defined as cyclohexane-insoluble matter B, wherein the cyclohexane-insoluble matter A and B are calculated from the following expression:

$$\text{cyclohexane insoluble matter (\%)}=([W2-W3]/[W1-W3])\times 100$$

where,

W1 represent a mass of a sample of the toner,

W2 represents a mass of an extract residue of the sample of the toner, which is obtained by subjecting the sample of the toner to the Soxhlet extraction, and W3 represents a mass of an incineration ash of the sample of the toner, which is obtained by subjecting the sample of the toner to heating at about 900° C. for about 3 hours, cyclohexane-insoluble matter A is 70.0% by mass or more; and cyclohexane-insoluble matter B is 40.0% by mass or less, and wherein:

z-average molecular weight Mz and the weight-average molecular weight Mw of a tetrahydrofuran-soluble matter of the carboxy-containing styrene-based resin, determined by gel permeation chromatography measurement, satisfy the following expressions:

$10000 \leq Mw \leq 30000$;

$1.62 \leq Mz/Mw \leq 5.00$.

2. The toner according to claim 1, wherein the toner particles contain from 5.0% by mass or more to 23.0% by mass or less of the carboxy-containing styrene-based resin with respect to the total mass of the toner particles.

3. The toner according to claim 1, wherein the carboxy-containing styrene-based resin contains a hydroxy group.

4. The toner according to claim 1, wherein when the hydroxyl value of the carboxy-containing styrene-based resin represents OHv (mg KOH/g), and the acid value of the carboxy-containing styrene-based resin represents Av (mg KOH/g), OHv and Av satisfy the following expressions:

$5.0 \leq OHv \leq 30.0$, and $5.0 \leq Av \leq 25.0$.

5. The toner according to claim 1, wherein each of the toner particles contains a polyester resin.

6. The toner according to claim 1, wherein the toner particles are produced by the following steps of:

adding a polymerizable monomer composition containing a polymerizable monomer to an aqueous medium, granulating the polymerizable monomer composition in the aqueous medium to form particles of the polymerizable monomer composition, and polymerizing the polymerizable monomer.

7. The toner according to claim 6, wherein a water-soluble polymerization initiator is added to the aqueous medium.

* * * * *